US008915579B2

(12) United States Patent
Hamasaki et al.

(10) Patent No.: US 8,915,579 B2
(45) Date of Patent: Dec. 23, 2014

(54) INKJET PRINTING DEVICE AND METHOD FOR REPLACING A PRINT HEAD

(75) Inventors: Yuji Hamasaki, Kawasaki (JP); Atsushi Takahashi, Kawasaki (JP); Yoshinori Nakagawa, Kawasaki (JP); Nobuhiro Kitabatake, Kawasaki (JP); Naomi Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 13/217,453

(22) Filed: Aug. 25, 2011

(65) Prior Publication Data

US 2012/0050421 A1 Mar. 1, 2012

(30) Foreign Application Priority Data

Aug. 31, 2010 (JP) ..... 2010-194737

(51) Int. Cl.
*B41J 2/175* (2006.01)

(52) U.S. Cl.
CPC ..... *B41J 2/17509* (2013.01)
USPC ..... 347/85

(58) Field of Classification Search
CPC ..... B41J 2/17523; B41J 2/17556; B41J 2/18; B41J 2/17503; B41J 2002/17516
USPC ..... 347/29, 30, 84–86
See application file for complete search history.

(56) References Cited

U.S. PATENT DOCUMENTS

| | | | | |
|---|---|---|---|---|
| 6,139,127 | A * | 10/2000 | Kato et al. | 347/15 |
| 6,170,939 | B1 * | 1/2001 | Ujita et al. | 347/86 |
| 6,874,876 | B2 * | 4/2005 | Ishizawa et al. | 347/86 |
| 7,052,106 | B1 * | 5/2006 | Onuma et al. | 347/22 |
| 7,431,438 | B2 * | 10/2008 | Tsujimoto et al. | 347/86 |
| 7,461,932 | B2 | 12/2008 | Iwasaki et al. | |
| 8,506,059 | B2 * | 8/2013 | Hamasaki et al. | 347/85 |
| 2002/0036671 | A1 * | 3/2002 | Takahashi et al. | 347/29 |
| 2003/0160848 | A1 * | 8/2003 | Taniguchi et al. | 347/86 |
| 2010/0277553 | A1 * | 11/2010 | Karppinen et al. | 347/85 |
| 2011/0050814 | A1 * | 3/2011 | Tsubaki et al. | 347/85 |
| 2011/0128330 | A1 * | 6/2011 | Chen et al. | 347/85 |

FOREIGN PATENT DOCUMENTS

| | | | |
|---|---|---|---|
| JP | 63-045307 | A | 9/1988 |
| JP | 2001-018412 | A | 1/2001 |
| JP | 2003-326739 | A | 11/2003 |

OTHER PUBLICATIONS

Office Action in Japanese Patent Application No. 2010-194737, dated Mar. 18, 2014.

* cited by examiner

*Primary Examiner* — An Do
(74) *Attorney, Agent, or Firm* — Fitzpatrick, Cella, Harper & Scinto

(57) ABSTRACT

An inkjet printing device includes a print head for ejecting ink, a carriage provided with the print head detachably mounted thereon for moving the print head, an ink tank placed outside the carriage for storing ink, an ink supply path for supplying ink from the ink tank to the print head, and a discharge unit for discharging ink in the print head. Before the print head is detached from the carriage, the discharge unit discharges the ink in the print head.

6 Claims, 7 Drawing Sheets

INKJET PRINTING DEVICE AND METHOD FOR REPLACING A PRINT HEAD

BACKGROUND OF THE INVENTION

1. Field of the Invention

This invention relates to an inkjet printing device and a method for replacing a print head of an inkjet printing device. More particularly, this invention relates to techniques for connecting an ink tank and a print head with a supply path such as an ink supply tube and preventing ink from leaking from the supply path when the print head is removed from the supply path for print-head replacement or the like.

2. Description of the Related Art

In the inkjet printing devices, there is known a method for connecting an ink tank and a print head with an ink supply path such as a tube to supply ink from the ink tank to the print head. In this method, the ink tank is typically mounted in a fixed position within the inkjet printing device. The ink tank and the print head mounted on a carriage are connected to each other by use of the ink supply path such as the tube, thereby supplying the ink from the ink tank to the print head. In the following, this method is referred to as an "off-carriage tank method" for the sake of convenience.

The off-carriage tank method has advantages of eliminating the need for ensuring a large area for placement of a main ink tank on the carriage, not imposing a large load at the carriage movement, and storing a large amount of ink to be supplied to the print head.

However, this method has a risk of residual ink in the print head or the ink supply path leaking from there to result in an ink stain damaging an area around the print head or the ink supply path when or after the print head is or has been removed. Of methods implemented to address such disadvantages, for example, a method uses an on-off valve placed in a pressurization path for an ink supply to release the pressure in the ink supply path when the print head is replaced. Another method uses means for varying the inner capacity of the ink supply path to adjust the pressure in the ink supply path. Specifically, in any of these methods, the pressure in the ink supply path when the print head is removed is reduced to be lower than that at the ink supply, thus preventing the ink leakage from the ink supply path or the like.

However, in any of the methods, the pressure in the ink supply path can be reduced only to an atmospheric pressure at a maximum. Accordingly, when the print head is removed under such conditions, risks of scattering and dripping of the residual ink remaining in the joint between the print head and the ink supply path still remain. The methods provide an inadequate reduction in an ink stain damaging the surroundings.

To address this, Japanese Patent Laid-Open No. 2001-018412 discloses a structure including an ink-suction hole provided in an ink supply needle and sucking means provided in an ink supply path. Specifically, Japanese Patent Laid-Open No. 2001-018412 discloses the structure in which, upon removal of the print head, a negative pressure is generated in the ink supply path and thereby the generated negative pressure acts in the print head through the ink supply hole formed in the ink supply needle, thus returning the ink in the print head back into the ink supply path.

However, employment of such a structure including the ink-suction hole provided in the ink supply needle and the negative-pressure generating mechanism for suction provided in the ink supply path, as described in Japanese Patent Laid-Open No. 2001-018412, provides a complicated structure of an ink supply unit because of replacement of the print head. As a result, this structure brings in complexity, an increase in size or cost, and the like in the inkjet printing device.

SUMMARY OF THE INVENTION

It is an object of the present invention to provide an inkjet printing device capable of inhibiting ink scattering and ink leaking at the time of replacing a print head without causing complexity of an ink supply unit and an increase in size of the inkjet printing device.

To attain this object, the present invention provides an inkjet printing device, comprising: a print head for ejecting ink; a carriage provided with the print head detachably mounted thereon for moving the print head; an ink tank placed outside the carriage for storing ink; an ink supply path for supplying ink from the ink tank to the print head; and a discharge unit for discharging ink in the print head, wherein before the print head is detached from the carriage, the discharge unit discharges the ink in the print head.

According to the present invention, it is possible to provide an inkjet printing device capable of inhibiting the ink scattering and ink leaking at the time of replacing the print head to reduce an ink stain at the time of replacing the print head and to achieve proper replacement of the print head, without causing complexity of an ink supply needle and an increase in size of the inkjet printing device.

Further features of the present invention will become apparent from the following description of exemplary embodiments (with reference to the attached drawings).

DESCRIPTION OF THE EMBODIMENTS

Preferred embodiments according to the present invention will be described below with reference to the accompanying drawings. First, an inkjet printing device to be applied to an embodiment according to the present invention will be described.

Figure 1:
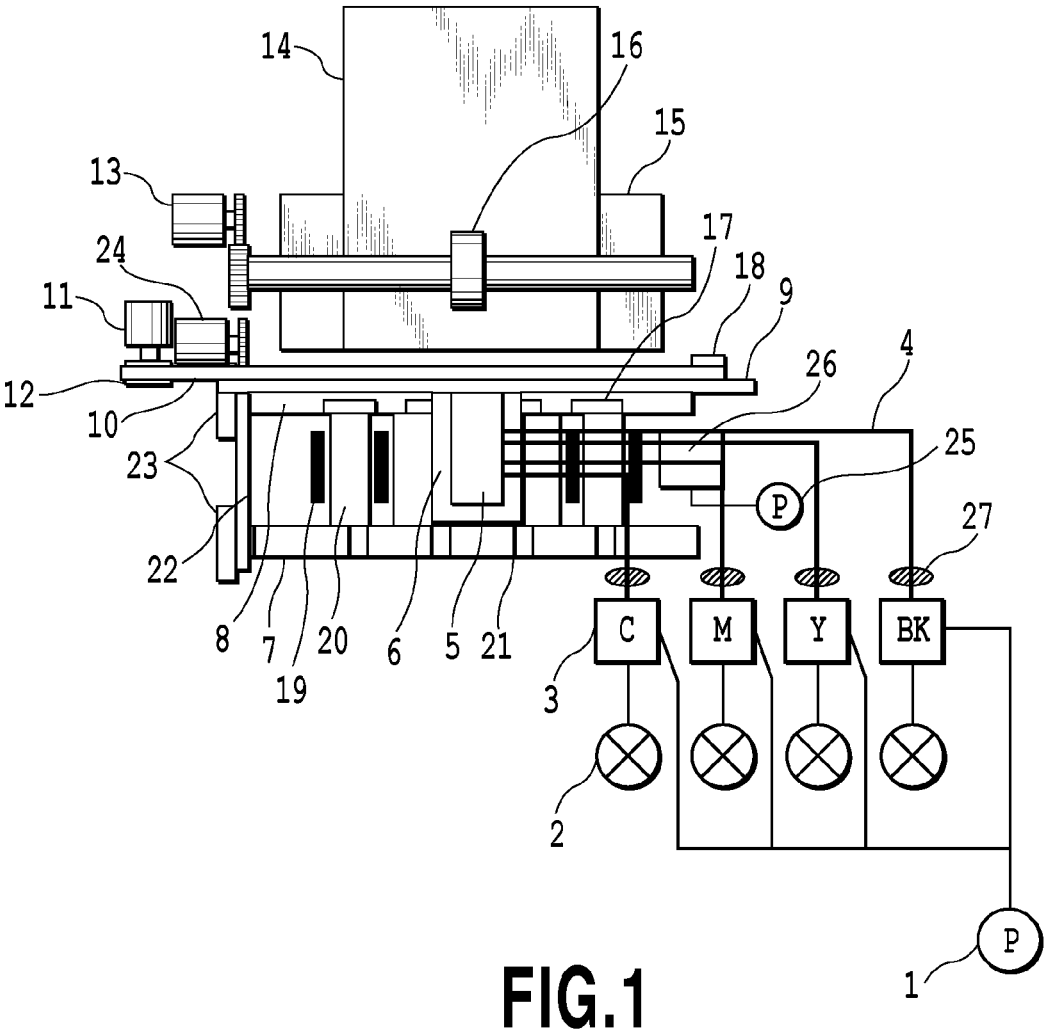
FIG. 1 is a schematic diagram illustrating an exemplary structure of an inkjet printing device according to the present invention.

FIG. 1 is a schematic diagram of an inkjet printing device according to the present invention. In FIG. 1, at 5 is indicated a print head that is detachably mounted on a carriage 6. The print head 5 has a print head unit including a plurality of printing elements for ejecting ink, for example, in a drop form, and an ink tank unit (sub-tank) for storing ink sent from main ink tanks 3 which are placed outside the carriage and for refilling each printing element with ink. The printing element includes, for example, a nozzle. Nozzle openings, which are ink ejection openings, are arranged on the ink ejection surface of the print head 5 (described later in detail with reference to FIG. 5). The print head 5 is provided with a connector for transmission/reception of signals for operation of the print head unit, while the carriage 6 is provided with a connector holder for transmission of drive signals and the like to the print head 5 through the connector.

The carriage 6 is guided and supported by a guide shaft 9 mounted in the body of the inkjet printing device, and can reciprocate in the main scan direction along the direction of extension of the guide shaft 9. The carriage 6 is moved by a main-scan motor 11 via a drive mechanism including a motor pulley 12, a driven pulley 18, a timing belt 10 and the like, while its position and its travel distance are controlled.

Before the printing operation, a print medium 14 is placed on an automatic sheet feeder 15. Upon start of the printing operation, a feeder motor 13 is driven. This drive force is transferred to a pickup roller 16 via a gear. Thereupon, the pickup roller 16 rotates to feed a print medium 14 on a one sheet-by-one sheet basis from the automatic sheet feeder 15 into the inkjet printing device. The print medium 14 thus fed is conveyed by torque of a conveying roller 8. At this stage, the conveying roller 8 is rotated by transfer of the torque produced by a conveying motor 24 through a gear. The conveying roller 8 is connected to a driven (discharge) roller 7 through a belt member 22, so that the driven roller 7 rotates upon the rotation of the conveying roller 8. The degree of rotation and the rotational speed of the conveying roller 8 are detected by a rotation angle sensor (not shown) recognizing a position of a slit cut in a code wheel 23 mounted on the conveying roller 8. The conveying roller 8 is controlled by executing feedback of the detected information into a control driver for the conveying motor 24. When the print medium 14 is conveyed between the conveying roller 8 and the driven roller 7, the print medium 14 is supported flatly by a platen 19 such that a flat print surface is created in a position facing the ink ejection surface of the print head 5. When the print medium 14 passes through underneath the ink ejection surface of the print head 5, the print head 5 ejects ink onto the print medium 14 according to a predetermined image signal. A pinch roller 17 and a spur roller 21 are disposed respectively to face the conveying roller 8 and the driven roller 7 such that the print medium is sandwiched between them. The pinch roller 17 and the spur roller 21 are auxiliary rollers for increasing the force holding the print medium 14. An ink absorption element 20 is placed between the conveying roller 8 and the driven roller 7. Since the ink absorption element 20 absorbs overflow ink from the print medium at the time of performing a borderless print operation on the print medium, the platen 19 can be prevented from getting soiled.

At 26 is indicated a cap, and the cap 26 is in contact with the surface of the print head on which the nozzles are arranged in order to prevent the nozzles from drying when the printing operation is not performed. A suction pump 25 is driven in a state where the cap 26 is in contact with the nozzle-array surface to generate a negative pressure in the cap 26, thus sucking ink within each nozzle of the print head. The cap 26 has also a function of receiving ink ejected from the print head in the so-called auxiliary ejection operation. By the ink suction and the auxiliary ejection operation as described above, bubbles trapped in the ink within the print head and the thickened ink are discharged through the ink ejection opening, leading to the print head maintained in a smooth ejection condition. The operations are called "recovery operation".

A tube 4 which is an ink supply path for each ink color connects each main ink tank 3 to the print head 5 so that ink can be supplied from the main ink tank 3 into the print head 5. A pressure pump 1 pressurizes the main ink tank 3 during an ink supply so that the ink is sent into the print head 5 through the tube 4. Each of the main ink tanks 3 is provided with an atmosphere communication valve 2 to be capable of controlling presence/absence of pressurization.

Another valve 27 is provided on the path of the tube 4 for the turning-off/turning-on of the ink supply. The valve 27 is formed of a flexible film to be opened/closed. The valve 27 is switched to the closed position for detachment of the print head by performing the ink suction or auxiliary ejection operation on the print head 5 after the applied pressure in the tube 4 has been released. As a result, the negative pressure in the tube can be increased by the operation of the ink suction or auxiliary ejection.

Figure 2:
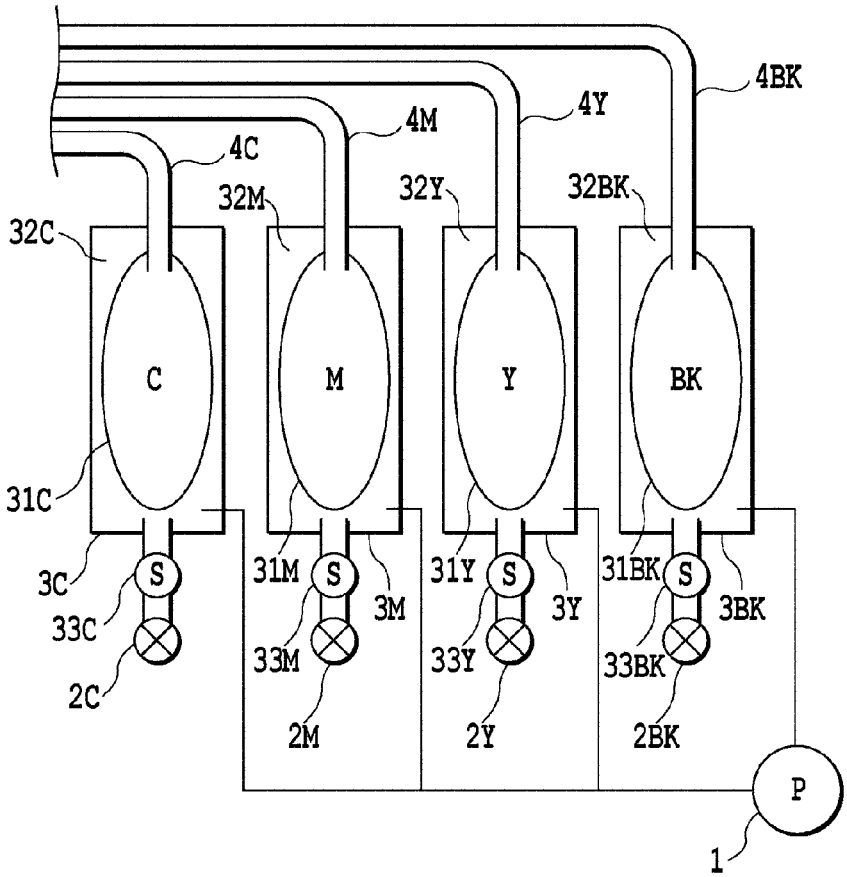
FIG. 2 is a diagram illustrating the structure of a main ink tank used in an embodiment according to the present invention.

FIG. 2 is a detailed diagram of the main ink tank 3. The pressure pump 1 is shared among the main ink tanks. The main ink tank 3 is composed of four tanks provided respectively for different ink colors, namely, cyan 3C, magenta 3M, yellow 3Y and black 3BK. Likewise, reference signs 2C, 2M, 2Y, 2BK denote atmosphere communication valves (pressure relief valves) communicated with the respective main ink tanks. Reference signs 31C, 31M, 31Y, 31BK denote ink bags containing respectively the different color inks. The main ink tanks 3 respectively have clearances which are designated respectively by reference signs 32C, 32M, 32Y, 32BK and formed between their inner walls and the corresponding ink bags 31C, 31M, 31Y, 31BK. A pressure pump 1 is connected to the clearance 32. The ink bags 31C, 31M, 31Y, 31BK are connected respectively to the tubes 4C, 4M, 4Y, 4BK which are connected to the print head 5. Since the main ink tanks 3 for the respective ink colors are identical in function with each other, the cyan main ink tank 3C will be described as a representative of them. Initially, when the atmosphere communication valve 2C is in the closed position, the pressure pump 1 is operated. Thereupon, the air in the clearance 32C between the ink bag 31C and the main ink tank 3C is pressurized to compress the ink bag 31C. By pressing the ink bag 31C, the ink in the ink bag 31C is sent through the tube 4C to the print head 5. At this stage, since, upon switching the atmosphere communication valve 2C to the open position, the air within the clearance 32C between the ink bag 31C and the main ink tank 3C has a pressure equal to the atmospheric pressure, the ink bag 31C is stopped being pressurized. Since the atmosphere communication valve in each main ink tank can be independently controlled to open/close, control on the presence/absence of pressurization in each main ink tank is made possible. Preferably, a pressure detecting unit designated by each of 33C, 33M, 33Y, and 33BK should be provided in each main ink tank 3 or each tube 4. An output result of the pressure detecting unit 33 can be used for a timing trigger for adjustment to the applied pressure in an ink supply or for cleaning of the print element such as the nozzle.

Figure 3:
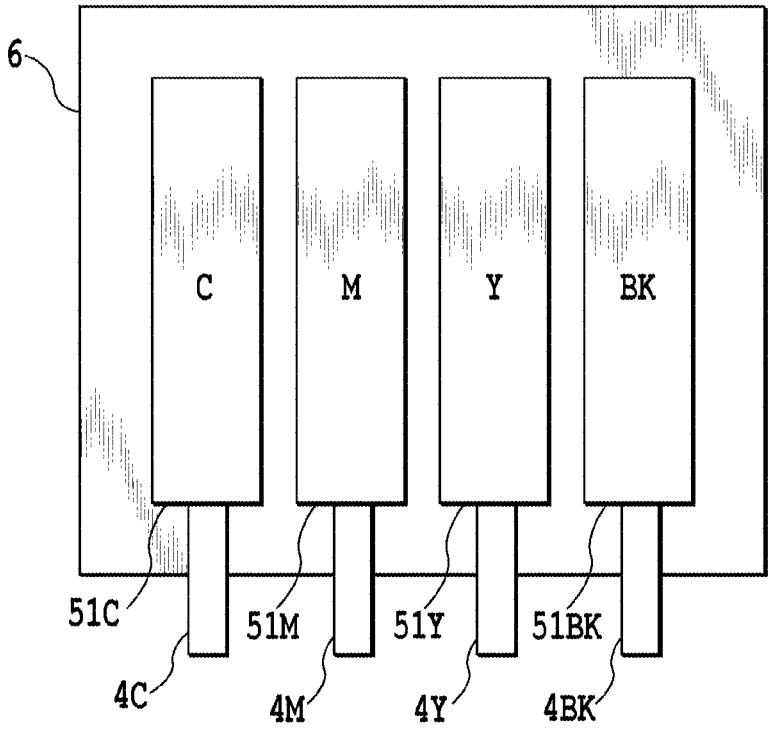
FIG. 3 is a diagram illustrating the structure of a carriage used in an embodiment according to the present invention.

Next, FIG. 3 is a detailed diagram of the carriage 6. The sub tanks 51 containing respectively the different color inks (cyan 51C, magenta 51M, yellow 51Y, black 51BK) are placed on the carriage 6 for supplying the ink to the print head 5. The sub tank 51 is necessary to maintain a negative pressure in the print head 5 and to perform appropriate ink supply.

Figure 4:
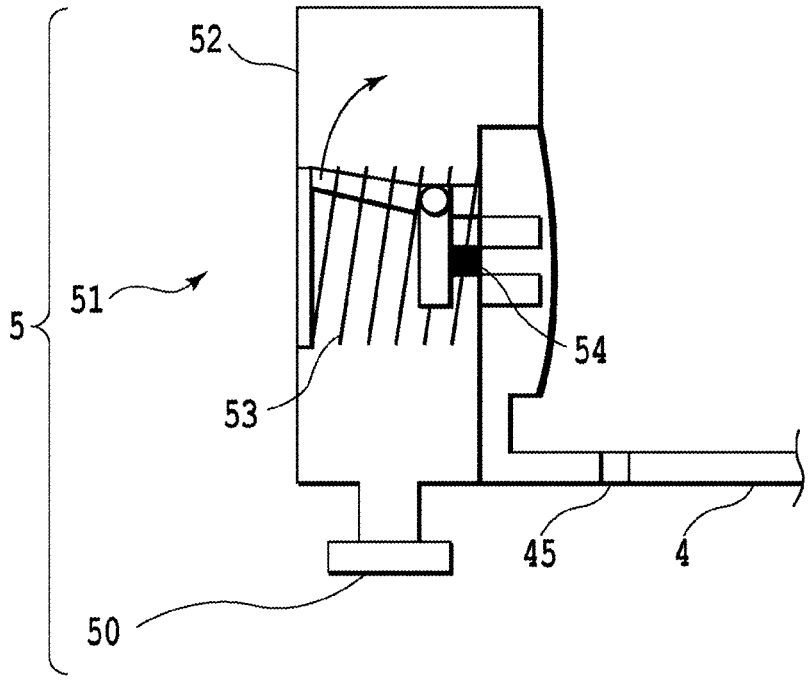
FIG. 4 is a diagram illustrating the structure of a sub-tank used in an embodiment according to the present invention.

FIG. 4 is a detailed diagram of the sub tank (ink tank unit) 51. The sub tank 51 is coupled to the print head unit 50 including a plurality of nozzles for ink ejection, to form the print head 5. The tube 4 is connected through a joint 45 to the sub tank 51. That is, at replacement of the print head, the print head 5 including the sub tanks 51 and the tube 4 are separated or jointed together at the joint 45. The sub tank 51 is adapted to be placed under a negative pressure by a spring bag 52 capable of storing ink and a spring 53 urged in a direction of expanding the spring bag 52. A supply check valve 54 is mounted in the sub tank 51 for proper control on the amount of ink stored in the sub tank 51. Upon contraction of the spring 53 because of consumption of the ink in the sub tank 51, a lever is pushed in the direction of the arrow in FIG. 4 to open the supply check valve 54, thus allowing the flow of ink into the sub tank 51. When the sub tank 51 is filled with the ink, the state illustrated in FIG. 4 arises, thus closing the supply check valve 54. With the structure as described above, when ink is ejected through the print head unit 50 to start printing, ink is supplied to the sub tank 51, thus continuing the printing operation.

Figure 5:
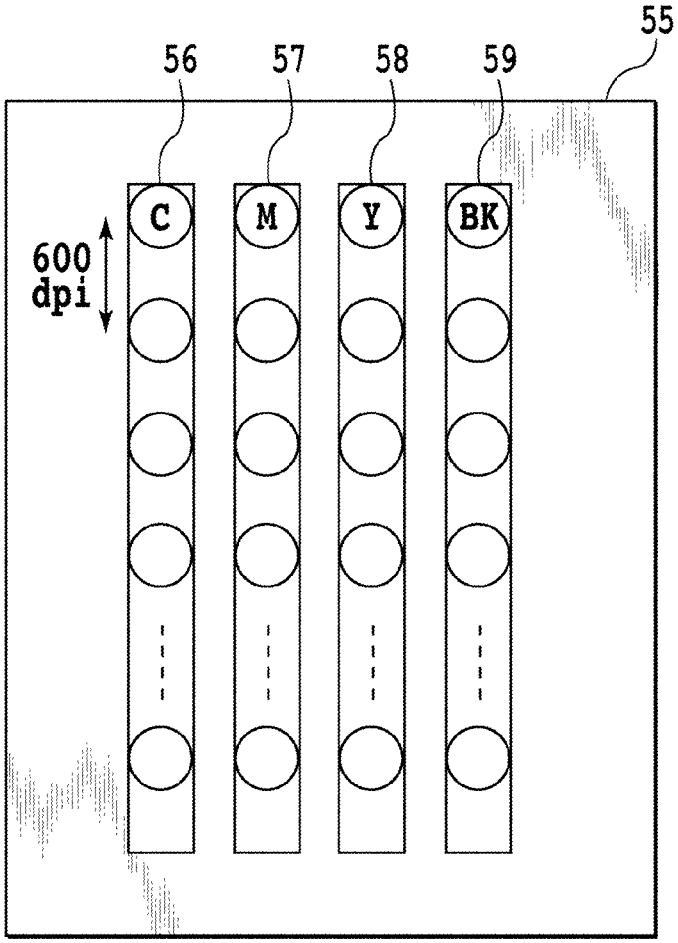
FIG. 5 is a diagram illustrating the nozzle structure of a print head used in an embodiment according to the present invention.

FIG. 5 is a diagram of the print head 5 when viewed from the ink ejection surface of the print head units 50. Each of circles shown in FIG. 5 represents a nozzle opening from which ink is ejected, that is, an ink ejection opening. A plurality of nozzles from which the inks of C, M, Y and BK colors are ejected respectively are arrayed according to ink colors on a single chip 55. Reference signs 56, 57, 58, 59 denote nozzle columns of nozzles for the ejection of cyan, magenta, yellow and black inks. The cap 26 making contact with the nozzles in order to prevent the nozzles from drying when the printing operation is not performed has a size covering the chip 55. An interval between nozzle holes in each nozzle column, that is, the distance between the center of one ink ejection opening and the center of an adjacent ink ejection opening, is 600 dpi (see the arrows in FIG. 5).

The print head 5 to be applied to an embodiment of the present invention is of an inkjet type using thermal energy to eject ink, and includes a plurality of electrothermal conversion elements for generating thermal energy. Specifically, thermal energy is generated by pulse signals applied to the electrothermal conversion element, causing film boiling in the liquid ink. Then, the bubble pressure of the film boiling is used to eject the ink from the ink ejection opening for printing.

Embodiments according to the present invention using the inkjet printing device described above will be described below.

First Embodiment

Figure 6:
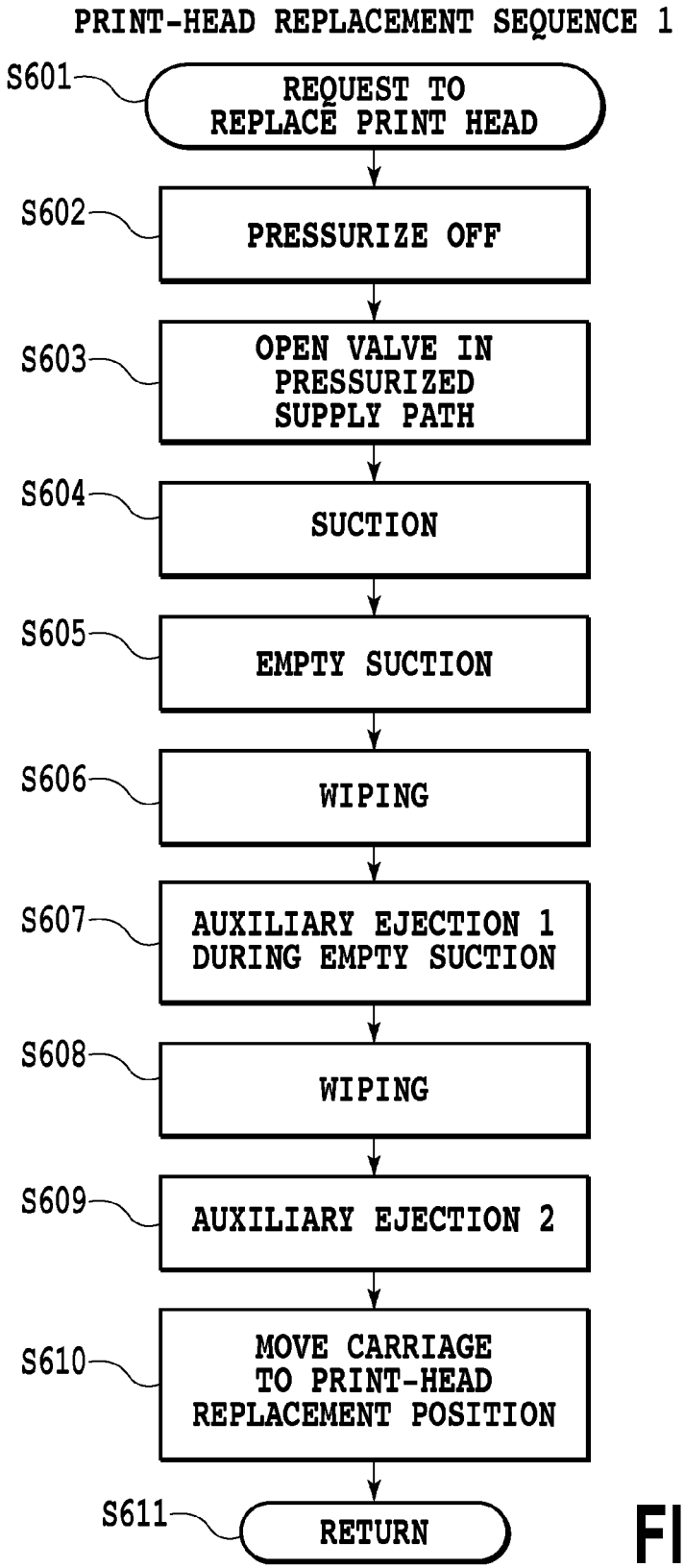
FIG. 6 is a diagram illustrating the control flow showing a print-head replacement sequence according to a first embodiment of the present invention.

FIG. 6 is a control flow chart of print-head replacement sequence 1 according to a first embodiment.

In the inkjet printing device according to the first embodiment of the present invention, if an operation for removing the print head 5 is requested because, for example, the need for replacement of the print head 5 arises (step S601), the pressure pump 1 of the main ink tank 3 is stopped (step S602). Then, the atmosphere communication valve 2 mounted in a pressurized section of the tube 4 is switched to the open position (step S603). This operation releases the pressurization state in the tube 4, so that the pressure in the tube 4 is reduced substantially to an atmospheric pressure. However, if the print head is detached in this condition, a residual ink remaining in the joint 45 between the print head 5 and the tube 4 is scattered by a residual pressure in the tube 4 or the detaching operation, possibly giving rise to ink dripping. To address it, the present invention performs an ink suction operation by using the ink suction mechanism including the cap 26 and the suction pump 25 in communication with the cap 26 after the atmosphere communication valve 2 in the pressurization section has been switched to the open position (step S604). Specifically, in any of the processes until step S604, the ink ejection surface of the print head 5 is covered with the cap 26 such that the cap 26 makes close contact with the ink ejection surface. Then, at step S604 the ink is sucked via the cap from the ink ejection opening by the ink suction mechanism. At the time when the ink suction operation is performed, the tube 4 is not pressurized and the ink is not supplied. Accordingly, the pressure in the tube 4 is lower than the atmospheric pressure at the time, that is, is a negative pressure.

Then, the close contact between the cap 26 and the print head 5 is released for empty suction in the cap 26 to discharge ink resulting from the ink suction operation at step S604 from within the cap (step S605). The "empty suction" described herein means suction performed without contact between the cap 26 and the print head 5, thereby enabling the ink discharged into the cap to be discharged out of the cap. Next, drips of ink adhering to the ink ejection surface of the print head through the ink suction operation at step S604 are swept away with a wiper blade (step S606). Then, an auxiliary ejection operation 1 is performed to discharge the ink of the mixed color in the print head 5 resulting from the wiper operation at step S606, and simultaneously the ink in the cap 26 is removed by empty suction (step S607). Then, the ink ejection surface of the print head 5 in which the ink ejection nozzles are arranged is cleaned up by the wiper blade (step S608). An auxiliary ejection operation 2 is performed to remove the ink entering the ink ejection nozzles by the wiper operation at step S608 (step S609). After the control of placing the interior of the tube under the negative pressure and the maintenance operation for the print head have been performed, the carriage on which the print head is mounted is moved to a position for replacing the print head such as, for example, a central portion of the inkjet printing device or the like, to allow replacement of the print head (step S610). This is the end of the print-head replacement sequence.

By the control of placing the interior of the tube 4 under the negative pressure, a pressure difference is produced such that the ink is drawn into the tube 4. Thus, the risk of scattering of ink from the joint 45 between the print head 5 and the tube 4 is reduced. The pressures in the print head and the tube located on both sides of the joint 45 are reduced to a negative pressure as compared with an atmospheric pressure. For this reason, even if a residual ink remains, for example, on a protrusion of the joint 45 between the sub tank 51 and the tube 4 and the like, the residual ink moves in directions of being drawn into the interiors of the sub tank 51 and the tube 4 from the joint 45. As a result, the risk of occurrence of ink drips is further reduced.

Second Embodiment

Figure 7:
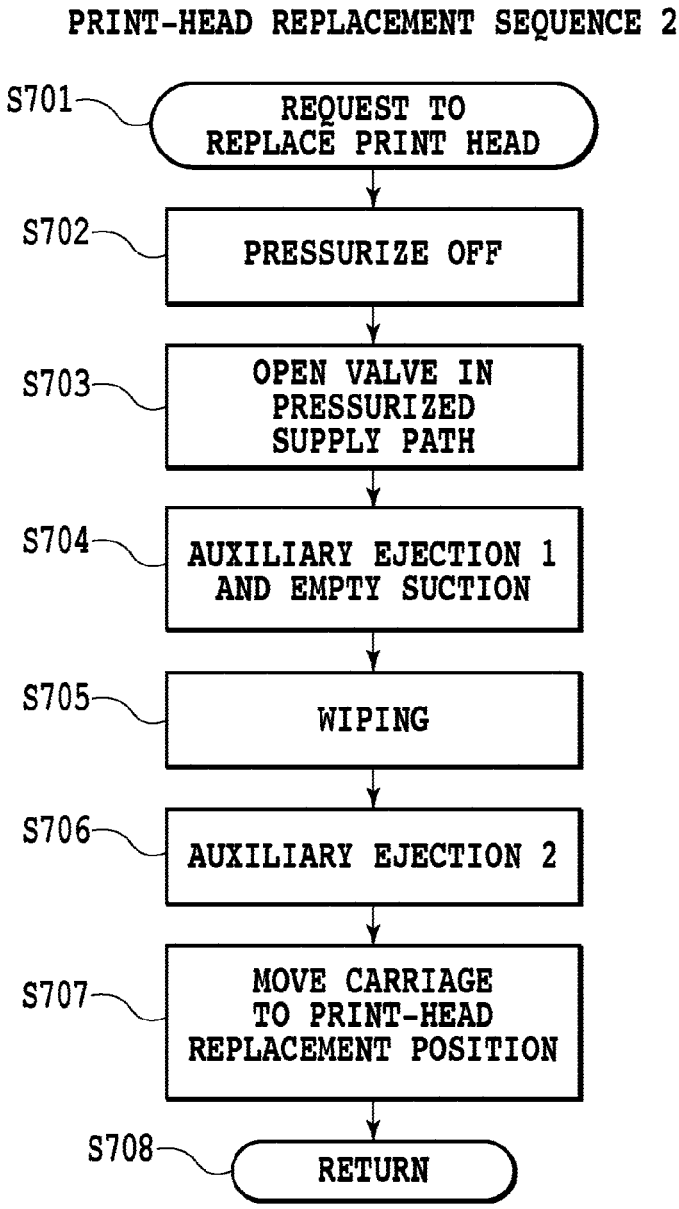
FIG. 7 is a diagram illustrating the control flow showing a print-head replacement sequence according to a second embodiment of the present invention.

FIG. 7 is a control flow chart of print-head replacement sequence 2 according to a second embodiment.

In the inkjet printing device according to the second embodiment of the present invention, if an operation for removing the print head 5 is requested because, for example, of the need for replacement of the print head 5 (step S701), the pressure pump 1 of the main ink tank 3 is stopped (step S702). Then, the atmosphere communication valve 2 mounted in a pressurized section of the tube 4 is switched to the open position (step S703). This operation releases the pressurization state in the tube 4, so that the pressure in the tube 4 is reduced substantially to an atmospheric pressure.

In the present invention, an auxiliary ejection operation 1 for ejecting ink is performed after the atmosphere communication valve 2 in the pressurization section has been switched to the open position (step S704). When the auxiliary ejection operation 1 is performed, the tube 4 is not pressurized and the ink is not supplied. Accordingly, the pressure in the tube 4 is lower than the atmospheric pressure at the time, that is, becomes a negative pressure. Then or simultaneously with this, empty suction in the cap 26 is performed to discharge the ink resulting from auxiliary ejection operation 1 from within the cap (step S704). Then, a wiper blade is used to clean up the ink ejection surface of the print head 5 (step S705). Then, an auxiliary ejection operation 2 for ink is performed in order to discharge the ink entering the ink ejection nozzles by the wiper operation at step S705 (step S706). After the control of placing the interior of the tube under a negative pressure and the maintenance operation for the print head have been performed, the carriage on which the print head is mounted is moved to a position for replacing the print heads such as, for example, a central portion of the inkjet printing device or the like, to allow replacement of the print head (step S707). This is the end of the print-head replacement sequence.

By the control of placing the interior of the tube 4 under the negative pressure, a pressure difference is produced such that the ink is drawn into the tube 4. Thus, the risk of scattering of ink from the joint 45 between the print head 5 and the tube 4 is reduced. The pressures in the print head and the tube located on both sides of the joint 45 are reduced to the negative pressure as compared with an atmospheric pressure. For this reason, even if a residual ink remains, for example, on a protrusion of the joint 45 between the sub tank 51 and the tube 4 and the like, the residual ink also moves in directions of being drawn into the interiors of the sub tank 51 and the tube 4 from the joint 45. As a result, the risk of occurrence of ink drips is further reduced.

The above embodiments have described an example that the ink suction operation and the auxiliary ejection operation for placing the ink supply path under the negative pressure are performed in this order, and an example that the auxiliary ejection operation alone is performed. However, the negative pressurizing method according to the present invention is not limited to these examples, and the ink suction operation alone may be performed or a set of the ink suction operation and the auxiliary ejection operation may be performed in an arbitrarily order and in an arbitrarily number of times for ejection of ink from the print head.

According to the present invention, the aforementioned structure and control method make it possible to reduce the pressure in the ink supply path to a negative pressure lower than the atmospheric pressure at the time of replacing the print head. As a result, the residual ink is drawn into the ink supply path, so that scattering of the residual ink, the ink drips and the like can be inhibited from occurring in the joint between the print head and the ink supply path. According to the present invention, the need of the structure for controlling the pressure in the ink supply path is eliminated, so that it is not necessary to complicate the structures of the inkjet printing device, the print head, the ink tank and the like. Because of this, cost reduction effects and down sizing effects are advantageously produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194737, filed Aug. 31, 2010 which is hereby incorporated by reference herein in its entirety.

What is claimed is:

1. An inkjet printing device, comprising:

a carriage configured to move with a print head for ejecting ink, the print head being detachably mounted thereon;

an ink tank provided in a body of the device for storing ink to be supplied to the print head;

an ink supply tube for supplying ink from the ink tank to the print head;

a pressurizing unit configured to perform a pressurizing operation to pressurize the ink tank;

a suction unit configured to perform a suction operation to suck ink from the print head; and control means for bringing an inside of the ink supply tube to a state of a negative pressure when receiving a request for removing the print head from the carriage by stopping the pressurizing operation of the pressurizing unit and then causing the suction unit to perform the suction operation.

2. The inkjet printing device according to claim 1, wherein the suction unit includes a cap configured to contact an ejection surface of the print head and a suction pump configured to generate a negative pressure in the cap.

3. The inkjet printing device according to claim 1, wherein the ink tank includes an ink bag for containing ink, a housing for housing the ink bag, and an atmosphere communication valve configured to communicate a space between the ink bag and the housing to the atmosphere, wherein the control means controls the atmosphere communication valve to open upon receiving the request for removing the print head.

4. A method for replacing a print head of an inkjet printing device including the print head configured to eject ink, a carriage configured to detachably mount the print head and to move with the print head thereon, an ink tank provided in a body of the device for storing ink to be supplied to the print head, an ink supply tube for supplying ink from the ink tank to the print head, a pressurizing unit configured to perform a pressurizing operation to pressurize the ink tank, and a suction mechanism configured to perform a suction operation to suck ink from the print head, the method comprising the steps of:

receiving a request for removing the print head from the carriage;

stopping the pressurizing operation of the pressurizing unit after receiving a request for removing the print head from the carriage; and after stopping the pressurizing operation of the pressurizing unit, causing the suction unit to perform the suction operation to bring an inside of the ink supply tube to a state of negative pressure.

5. The method of replacing the print head according to claim 4, further comprising the step of performing an auxiliary ejection operation to discharge the ink in association with the step of causing the suction unit to perform the suction operation.

6. The method of replacing the print head according to claim 4, wherein the step of causing the suction unit to perform the suction operation also includes reducing a pressure in the print head to be lower than an atmospheric pressure.

* * * * *